United States Patent [19]

Powell

[11] Patent Number: 5,048,446

[45] Date of Patent: Sep. 17, 1991

[54] HARNESS FOR SECURING A FENDER TO A BOAT

[76] Inventor: James S. Powell, 6610 Shirley Pond Rd., Harrison, Tenn. 37341

[21] Appl. No.: 357,480

[22] Filed: May 26, 1989

[51] Int. Cl.[5] ..... B63B 59/02

[52] U.S. Cl. ..... 114/219; 114/343

[58] Field of Search ..... 114/343, 219, 230, 221 R, 114/364; 248/60, 95, 317, 323; 405/212, 213

[56] References Cited

U.S. PATENT DOCUMENTS

| | | | |
|---|---|---|---|
| 3,379,439 | 4/1968 | Sorenson et al. | 248/323 |
| 3,680,551 | 8/1972 | Bell et al. . | |
| 3,693,573 | 9/1972 | Murphy | 114/219 |
| 4,101,109 | 7/1978 | Edwards | 248/317 |
| 4,788,926 | 12/1988 | Ullman et al. | 114/219 |
| 4,841,893 | 6/1989 | Ellison | 114/219 |
| 4,843,994 | 7/1989 | Wilson et al. | 114/219 |
| 4,875,427 | 10/1989 | Harris | 114/343 |

OTHER PUBLICATIONS

"Ski Limited" 1989 Catalog—p. B-8.

*Primary Examiner*—Sherman Basinger
*Assistant Examiner*—Stephen P. Avila
*Attorney, Agent, or Firm*—Heiskell, Donelson, Bearman, Adams, Williams & Kirsch

[57] ABSTRACT

A harness for securing a fender to a boat, particularly a competition ski boat, is disclosed which includes an elongated strap member having at least two shorter strap members transversely disposed across one end of the elongated member to retain the boat fender and means for forming a loop from the opposite end of the elongated member for attaching the harness to a ski pylon or other hardware affixed to the floor of the boat. The length of the elongated member can be adjusted so that when the boat fender is suspended over the side of the boat the fender remains stationary along the side of the boat in a position which is substantially perpendicular to the surface of the water.

9 Claims, 6 Drawing Sheets

HARNESS FOR SECURING A FENDER TO A BOAT

The present invention relates to an apparatus for protecting boats from damage during docking, and more particularly to an adjustable harness for securing a fender to a boat.

BACKGROUND OF THE INVENTION

Although water skiing has long been a popular sport, competition and show skiing have rapidly increased in popularity in recent years. Competition water skiing generally requires the use of a specially designed boat which is more streamlined and has a lower profile in the water than traditional recreational boats. Competition ski boats are provided with a rod or ski pylon which ordinarily is affixed to the floor in approximately the center of the boat. The tow ropes which are used to pull the skiers are attached to the pylon to allow the ropes a full range of motion around the boat during skiing maneuvers. Since the safety of the skiers and the complexity of the skiing maneuvers requires completely unhampered movement of the tow ropes in all directions, the outside surfaces of competition ski boats are not generally provided with cleats, handrails or other hardware which could cause the ropes to snag while towing a skier. However, this lack of hardware makes it difficult to secure a fender or buoy to the boat in such a manner that the sides of the boat are protected from damage which can readily occur when parking the boat beside a dock, pier or along side another boat.

Prior to the present invention, the most common method of protecting a competition ski boat during docking was to suspend life jackets over the side of the boat as it approached a dock or another boat. This method has the obvious disadvantages of inflicting undue wear and tear on the life jackets and imperiling the safety of the passengers. Moreover, it is difficult to secure the life jackets to the side of the boat in a position which will protect the boat so that the operator can tend to other functions of the docking operation.

Inflated vinyl or polyvinyl cylindrical-shaped boat fenders or buoys are also used to absorb shock and protect all types of recreational boats during docking. However, these fenders are generally secured to the boat by a rope which is looped through eyes or grommets which are often provided in the ends of the fender. The rope is attached to a handrail, cleat, or other hardware on the side of the boat and the fender is allowed to hang over the side of the boat. This method of attaching the fenders is inadequate for most recreational boats because the fenders do not rest in a position which is perpendicular to the water and the fenders tend to slide back an forth along the edge and side of the boat, which significantly reduces the degree of protection afforded by the fenders. As with the life jackets, it is usually necessary for the operator or another passenger to manually retain the fender in a proper position to protect the boat when pulling along side a dock or another boat. Moreover, the lack of hardware on competition ski boats makes the use of such methods of attachment inconvenient.

Due to the significant costs involved in acquiring and maintaining a competition ski boat or other recreational water craft, a need continues to exist for a means to adequately absorb shock and protect boats from the potential of severe damage during docking without requiring the installation of hardware on the boat which hinders the free movement of the tow ropes when the boat is pulling a skier.

SUMMARY OF THE INVENTION

The present invention provides a novel harness for securing a fender to a competition ski boat. The harness includes an elongated strap member having at least two shorter strap members transversely disposed across the lower end of the elongated member to retain a boat fender. Means are provided for forming the upper end of the elongated strap member into a loop for attaching the harness to a ski pylon in the center of the boat. The length of the elongated strap member can be adjusted so that when the boat fender is suspended over the side of the boat, the uppermost shorter strap member is positioned against the upper edge of the boat. When the fender harness of the present invention is secured to a boat, the boat fender remains at a stationary point at the side of the boat in a position which is substantially perpendicular to the surface of the water.

It is an object of the present invention to provide an apparatus for protecting a boat from damage during docking.

It is another object of the present invention to provide a harness for securing a fender or a buoy to a boat.

An additional object of the present invention is to provide a fender harness which is adjustable in length to accommodate boats of different sizes and to allow the harness to be attached to the boat at several different points.

A further object of the present invention is to provide a fender harness which can be quickly attached to and removed from a ski pylon or other hardware on a boat as may be required during docking.

Yet another object of the present invention is to provide an adjustable harness which will secure a boat fender to a boat in such a manner that the fender remains in a stationary location along the side of the boat and rests in a position in the water which is substantially perpendicular to the surface of the water.

Other objects and features of the present invention will become apparent to those skilled in the art as the disclosure is made in the following description of a preferred embodiment of the present invention, as illustrated in the accompanying sheets of drawings.

DETAILED DESCRIPTION OF THE PREFERRED EMBODIMENT

Figure 3:
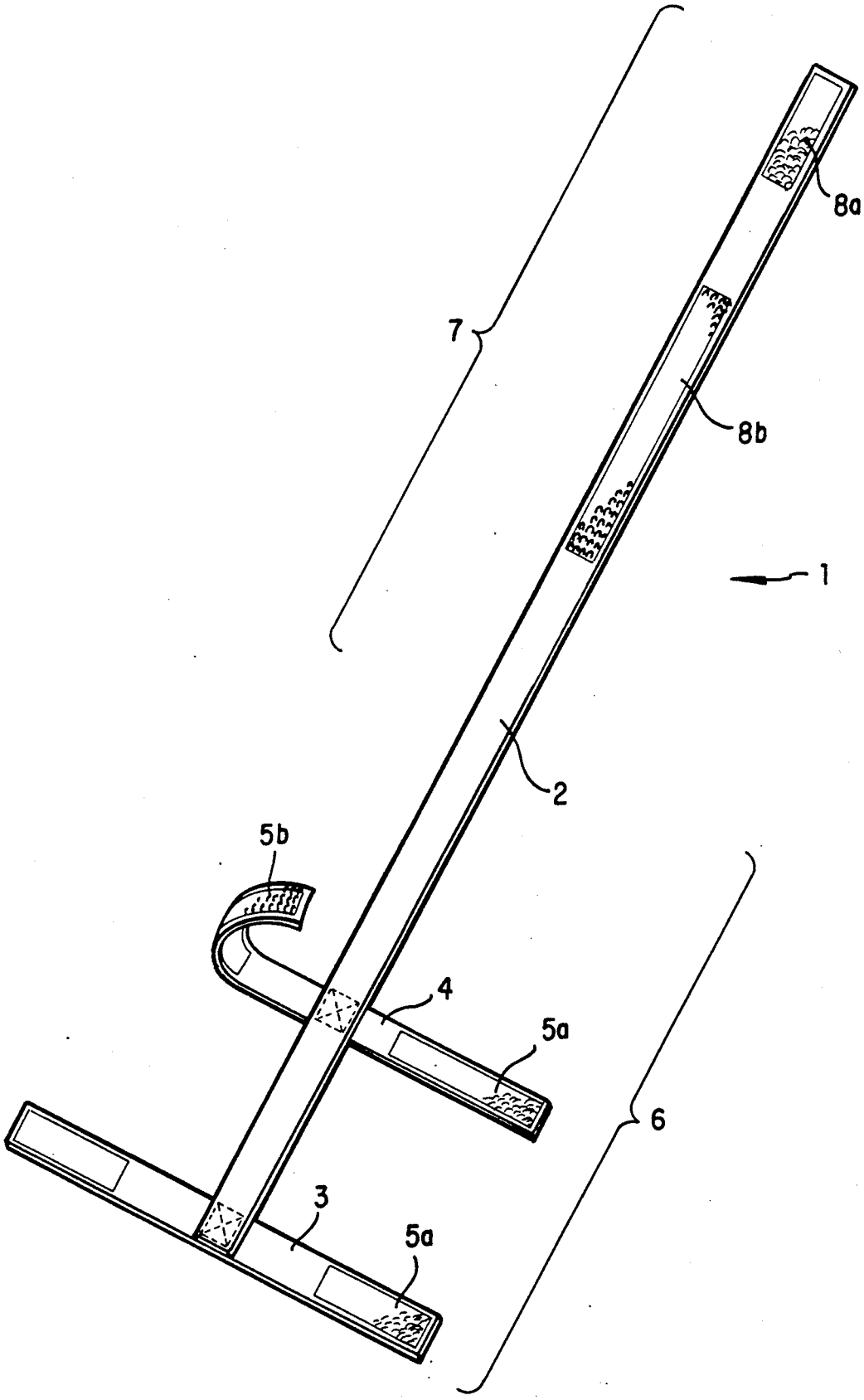
FIG. 3 is a perspective view of the fender harness of the present invention without a fender.

Referring to the drawings, and more particularly to FIG. 3, it is seen that the fender harness of the present invention, generally designated as 1, includes an elongated strap member 2 having a lower end 6 and an upper end 7.

A first short strap member 3 and a second short strap member 4 are transversely disposed across the lower end 6 of elongated member 2. Each of the short strap members 3,4 is affixed to the elongated strap member 2 by stitching or any other suitable means of attachment. In a preferred embodiment of the present invention, each of the short strap members 3,4 is attached to the elongated strap member 2 at approximately the mid-point of each of the short strap members 3,4. However, it is possible to attach the short strap members 3,4 to the elongated strap member 2 at any point along the length of the short strap members.

In a preferred embodiment, the first short strap member 3 is attached to elongated strap member 2 at a position which is substantially next to the edge of lower end 6. The second short strap member 4 then is attached to elongated member 2 at a spaced apart distance from the short strap member 3. Preferably, the two short strap members 3,4 are positioned on elongated strap member 2 in such a manner that short strap member 3 encircles approximately the mid-point of the lower half of a boat fender 10 and short strap member 4 encircles approximately the mid-point of the upper half of a boat fender 10. Thus, when the boat fender 10 is attached to harness 1, short strap members 3,4 are spaced an equal distance from each end of boat fender 10.

Short strap members 3,4 are provided with adjustable means for fastening the short strap members 3,4 around a boat fender 10. While any suitable adjustable means for fastening the short strap members 3,4 can be used, preferably the fastening means are of the hook and loop type which is commonly sold under the trademark VELCRO. As shown in FIG. 3, a fastener component 5*a* is mounted on the top side of one end of each strap member 3,4 and a complementary fastener component 5*b* is mounted on the bottom side of the opposite end of each strap member 3,4. The use of adjustable fastening means on short strap members 3,4 allows a fender 10 to be quickly adjusted up or down within the short strap members 3,4 as needed in a particular circumstance, such as to protect the boat from damage from high or low sitting docks. Also, the adjustable fastening means allows the harness 1 to secure fenders of different diameters.

The length of short strap members 3,4 and the positioning of short strap members 3,4 on the elongated member 2 are determined by the diameter and length of the particular boat fender to be secured. Most standard boat fenders are formed in a substantially cylindrical shape and then filled with air. Boat fenders generally are manufactured of a material such as vinyl or polyvinyl in a variety of standard lengths and diameters. One such boat fender which is commonly used is sold by the Nelson Taylor Company, P.0. Box 1190, Gloversville, N.J. 12028 and is approximately 20 inches long and 6 inches in diameter.

Short strap means 3,4 should be of sufficient length to allow the ends of each strap to completely encircle a boat fender 10 and overlap so that the complementary fastener components 5*a* and 5*b* interlock to firmly secure the boat fender 10 in the fender harness 1. In an alternate embodiment, a fastener component 5*a* can be mounted on both sides of one end of each of short strap members 3,4 and a fastener component 5*b* can be mounted on both sides of the opposite end of each of strap members 3,4 to allow the fastener components 5*a* and 5*b* to interlock when short strap members 3,4 are wrapped around the boat fender 10 in either direction.

Figure 4:
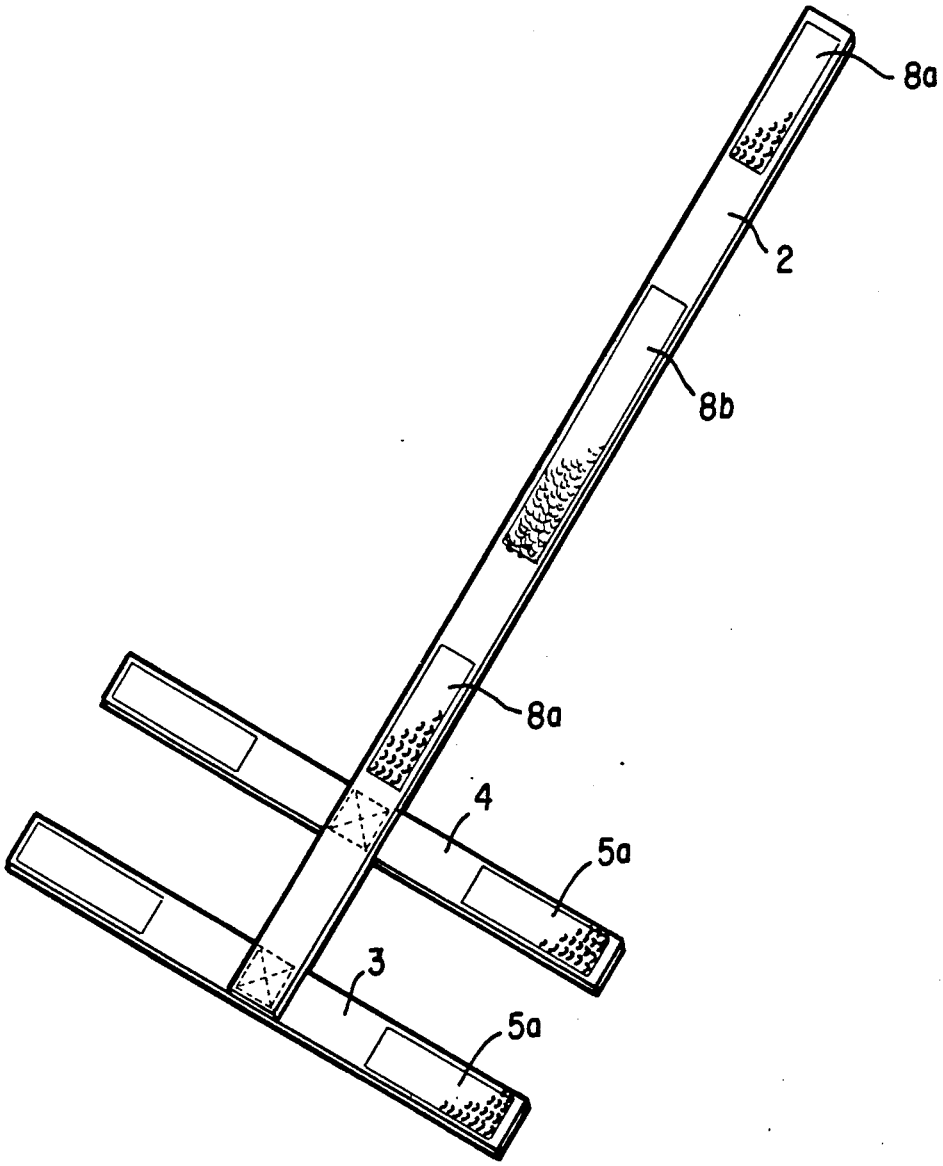
FIG. 4 illustrates another embodiment of the fender harness of the present invention.

As shown in FIG. 3, the upper end 7 of elongated member 2 is provided with adjustable fastening means 8*a* and 8*b* for forming a loop 9. While any suitable adjustable fastening means can be utilized to form upper end 7 into a loop, fastening means 8*a* and 8*b* are preferably of the hook and loop type which is commonly sold under the trademark VELCRO. As further shown in FIG. 3, both fastener components 8*a* and 8*b* are mounted on the same side of the upper end 7 of elongated strap member 2. Fastening component 8*a* is mounted on elongated strap member 2 at a point which is adjacent to the edge of upper end 7 of elongated strap member 2. Fastener component 8*b* is mounted on elongated strap member 2 at a point which is sufficiently spaced apart from fastener component 8*a* to allow the upper end of elongated member 2 to securely form a loop 9 when fastener components 8*a* and 8*b* are interlocked. Preferably, at least one of fastener components 8*a* or 8*b* is of sufficient length to allow an adjustable positioning of the complementary fastening components, 8*a* and 8*b* into various lengths depending upon the size of the boat and the point at which the fender harness is attached to a boat. The adjustable fastening means 8*a* and 8*b* also allows the harness to be adjusted as necessary should the harness material stretch or shrink after getting wet. Further, as shown on an alternate embodiment in FIG. 4, elongated strap member 2 can be provided with several complementary fastening means so that the same harness can be adjusted to secure a fender 10 from several different points on a boat, such as the floor hardware 15 shown in FIG. 5 or the handrail 16 shown in FIG. 6.

Figure 1:
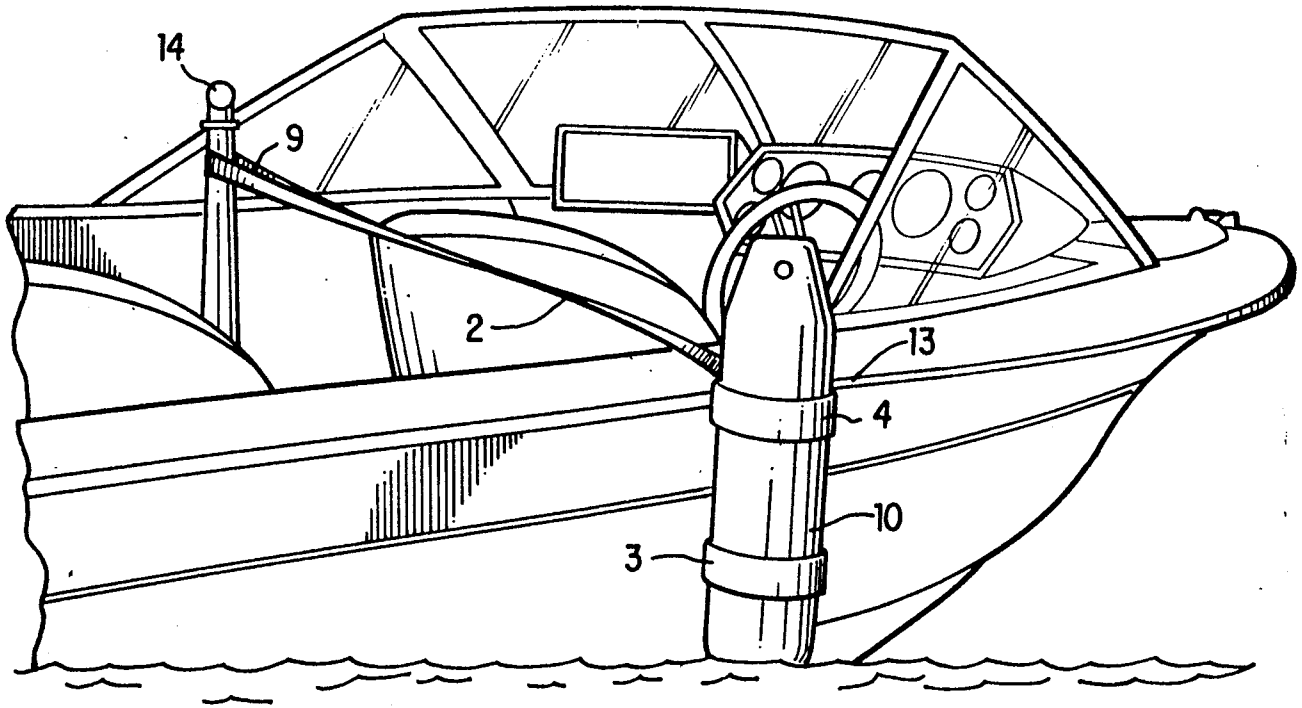
FIG. 1 is a perspective view showing the fender harness of the present invention attached to a ski pylon in the boat and suspending a fender over the side of the boat.
Figure 2:
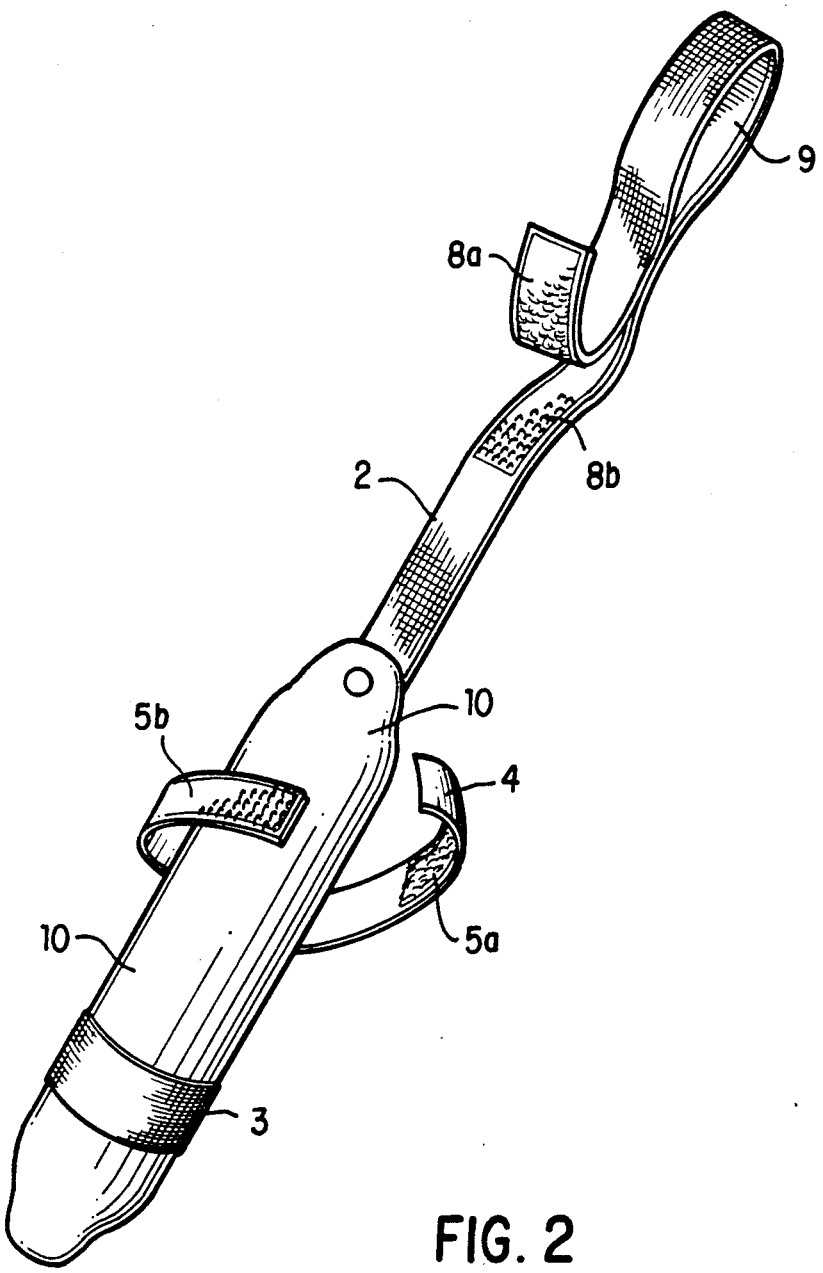
FIG. 2 is a perspective view of the fender harness of the present invention showing the adjustable means for securing the fender to the harness.

A boat fender 10 is secured to the harness 1 by placing the length of fender 10 along the lower end 7 of elongated strap member 2. Short strap members 3,4 are wrapped around approximately the mid-point of each of the upper and lower halves of boat fender 10 and fastener components 5*a* and 5*b* are interlocked to securely position fender 10 within harness 1 of the present invention. In order to provide a means for attaching the harness 1 to a boat, a loop 9 is formed from the upper end 7 of elongated strap member 2 by interlocking complementary fastener components 8*a* and 8*b*. The loop 9 is placed over the ski pylon 14 which is permanently affixed to the floor of th ski boat, as shown in FIG. 1. Alternately, as shown in FIG. 5, the upper end 7 of elongated strap member 2 can be inserted through an eyelet formed by hardware 15 attached to the floor of the boat. A loop 11 then is formed by interlocking complementary fastener components 8*a* and 8*b*.

Elongated strap member 2 and short strap members 3,4 are preferably made of polypropylene webbing or other similar material. Other suitable materials for the harness 1 include nylon strap, rope, cotton webbing, neoprene and other plastics. In a preferred embodiment, the webbing is substantially flat and is at least 1 ½inches wide. In a particularly preferred embodiment, the webbing is at least 2 inches wide. As shown in FIG. 1, the outer edge 13 of competition ski boats are generally wider than on other types of boats to better facilitate the entry and exit of the skiers and equipment. The use of an elongated strap member 2 which is at least to 2 inches wide significantly enhances the stability of the harness of the present invention and aids in securing a fender in a stationary location against the side of a boat and maintaining the fender in a position which is substantially perpendicular to the surface of the water.

It is important that the length of the elongated strap member 2 be properly adjusted so that the fender 10 will rest against the side of the boat in a vertical arrangement which is substantially perpendicular to the surface of the water. This vertical positioning of the fender 10 against the side of the boat provides maximum shock absorption and protection to the boat. The harness of the present invention is secured to a boat by varying the size of the loop 9 formed from upper end 7 of elongated strap member 2 so that the elongated strap member 2 is of such a length that the short strap member 4 is even with and rests against the upper edge 13 of the boat, as illustrated in FIGS. 1 and 5. When the fender harness 1 is secured to a boat in the manner so described, the fender 10 remains stationary against the side of the boat in a vertical position which is substantially perpendicular to the surface of the water. Thus, even as a boat travels through the water, the lower half of the boat fender 10 only sways slightly from the force of the water, and the top half of the fender 10 remains stationary at the point at which it is suspended over the edge 13 of the boat.

Figure 5B:
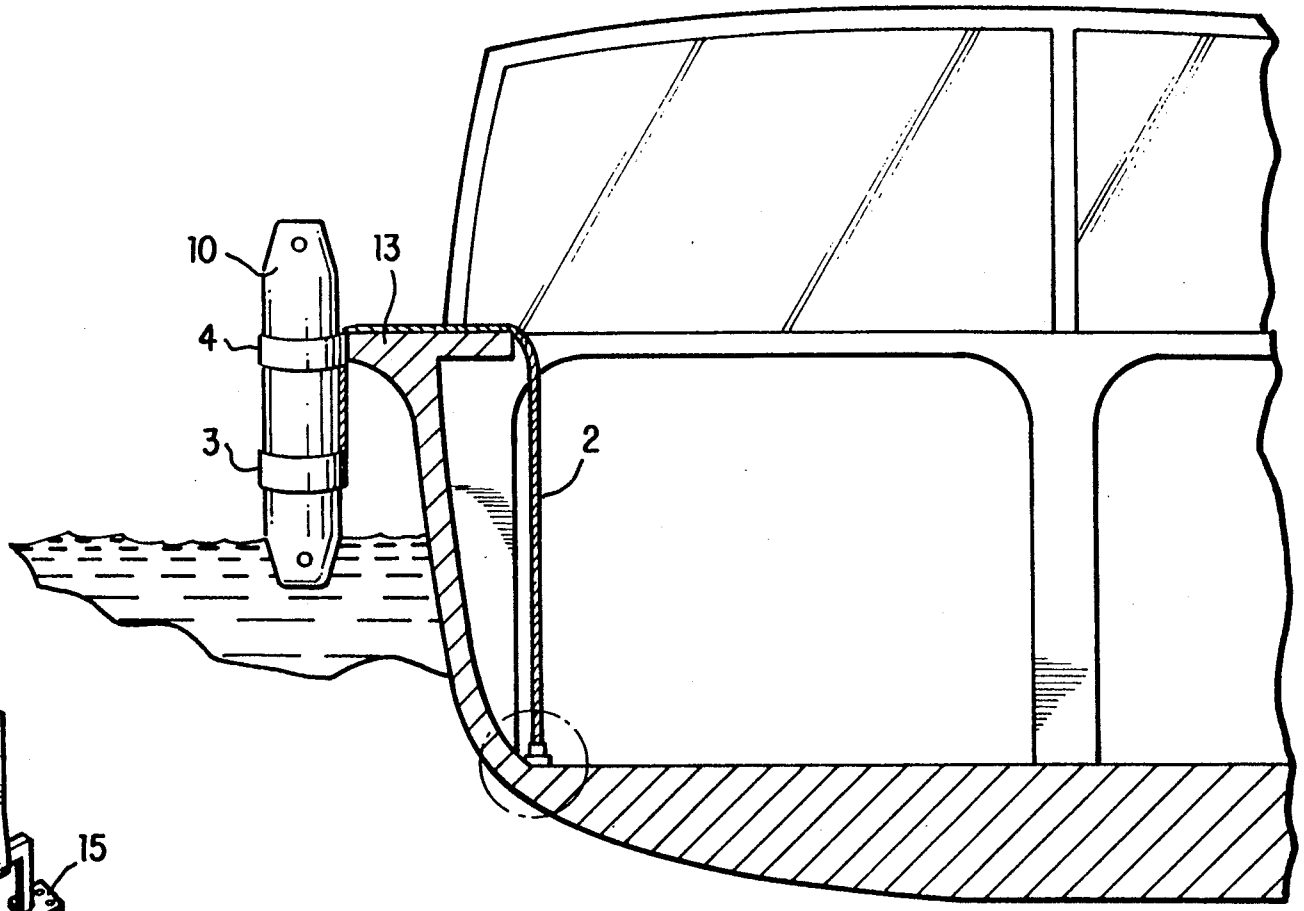
FIG. 5B illustrates an alternate arrangement for attaching the fender harness of the present invention to a boat with a detail inset FIG. 5A illustrating the hardware positioned on the floor of the boat.
Figure 5A:
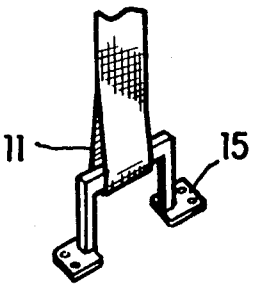
Figure 6:
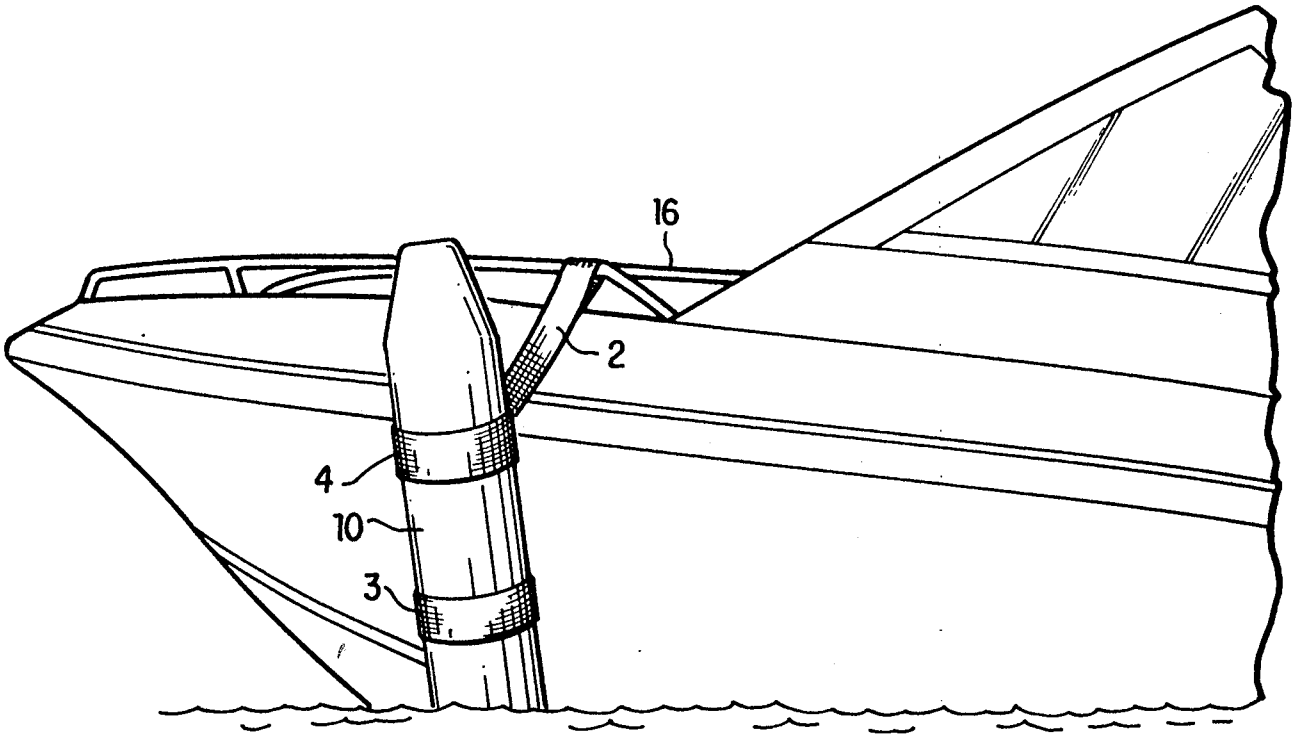
FIG. 6 illustrates yet another arrangement for attaching the fender harness of the present invention to hardware on a boat.

In a second embodiment of the harness 1 of the present invention, elongated strap member 2 can be adjusted to a shorter length and secured to hardware 15 which is affixed to the floor of the boat, as shown in FIGS. 5A and 5B. In yet another embodiment, shown in FIG. 6, the fender harness 1 can be attached to handrails 16, cleats, or any other hardware which is commonly supplied on recreational boats.

While the fender harness 1 of the present invention is particularly suitable for use in competition ski boats, the harness 1 is also suitable for use on any recreational boat. Additional harnesses of the present invention may be used to secure any number of fenders to a boat as may be necessary to protect the boat from damage during docking or parking along the side of another boat.

From the above, it is apparent that many modifications and variations of the present invention are possible in light of the above teachings. It is, therefore, to be understood that, within the scope of the appended claims, the invention may be practiced otherwise than as specifically described.

What I claim is:

1. An apparatus for protecting a boat which comprises:

a boat fender having an upper half and a lower half;

an elongated strap member having an upper end and a lower end;

adjustable fastening means mounted on the upper end of said elongated member for releasably forming the upper end of said elongated member into a loop, the size of said loop being adjustable to vary the length of said elongated member;

at least a first and a second short strap member which are disposed transversely across the lower end of said elongated member, the distance between said first and second short strap members being such that the first short strap member is positioned at substantially the mid-point of the upper half of said boat fender and the second short strap member is positioned at substantially the mid-point of the lower half of said boat fender, and the upper end of said elongated member extending substantially beyond the point at which said first short strap member is disposed across said elongated member.

2. An apparatus according to claim 1 wherein said adjustable fastening means for forming the upper end of said elongated member into a loop comprises a mating set of hook and loop type fastening strips which are mounted on the same side of said elongated strap member in such a manner that the upper end of said elongated strap member can be adjustably formed into a loop for securing the apparatus to a boat.

3. An apparatus according to claim 1 wherein the fastening means mounted on each of said short strap members is a mating set of hook and loop type fastening strips, said fastening strips being mounted on opposite sides of the free ends of each of said short strap members so that said fastening strips interlock to retain the boat fender when said short strap members are closed around said boat fender.

4. An apparatus according to claim 1 wherein said boat fender is cylinderically shaped, floatable tube.

5. A harness for securing a fender to a boat which comprises:

an elongated strap member having an upper end and a lower end;

adjustable fastening means mounted on the upper end of said elongated strap for forming the upper end of said elongated member into a loop;

at least two short strap members which are disposed transversely across the lower end of said elongated member for releasably attaching said fender to said harness, said short strap members being positioned on said elongated member so that said short strap members are spaced an equal distance from each end of said boat fender when said short strap members are attached to said fender, and the upper end of said elongated member extending substantially beyond the point at which said first short strap member is disposed across said elongated member; and adjustable fastening means mounted on each of said short strap members for releasably closing said short strap members around said boat fender.

6. A harness according to claim 4 wherein the length of said elongated strap member is such that when said loop is attached to said boat, the short strap member which is positioned at the mid-point of the upper half of said boat fender rests against the side of a boat when the fender is suspended over the side of the boat so that said boat fender remains at a stationary point against the side of the boat in a position which is substantially perpendicular to the surface of the water.

7. A harness according to claim 5 wherein said elongated strap member and short strap members are made of polypropylene webbing.

8. A harness according to claim 5 wherein said elongated strap member and said strap members are at least one and one-half inches wide.

9. A method of securing a fender to a boat which comprises:

forming an adjustable loop from one end of an elongated strap member having at least two short strap members which are disposed transversely across the lower end of said elongated member;

securing a boat fender to the end of the elongated strap member which is opposite said adjustable loop by wrapping said short strap members around said fender;

attaching the adjustable loop to hardware affixed to the inside of the boat; and adjusting the length of said elongated strap member in such a manner that the short strap member nearest the adjustable loop is even with and rests against the upper edge of said boat so that said fender remains in a position which is substantially perpendicular to the surface of the water.

* * * * *